US005941694A

United States Patent [19]

Tsutsui et al.

[11] Patent Number: 5,941,694

[45] Date of Patent: Aug. 24, 1999

[54] FLUID CONVEYING APPARATUS HAVING MULTIPLE PIEZOELECTRIC DRIVEN BLADES

[75] Inventors: Toshihiro Tsutsui; Kenji Shimanaka; Keiichirou Takatou; Kiichirou Miyanaga, all of Saitama-ken, Japan

[73] Assignee: Honda Giken Kogyo Kabushiki Kaisha, Tokyo, Japan

[21] Appl. No.: 08/948,331

[22] Filed: Oct. 10, 1997

[30] Foreign Application Priority Data

Nov. 6, 1996 [JP] Japan ..... 8-293623

[51] Int. Cl.[6] ..... F04B 35/04

[52] U.S. Cl. ..... 417/410.2

[58] Field of Search ..... 417/410.2

[56] References Cited

U.S. PATENT DOCUMENTS 4,923,000 5/1990 Nelson ..... 417/410.2

5,008,582 4/1991 Tanuma et al. ..... 417/410.2

FOREIGN PATENT DOCUMENTS 61-212699 9/1986 Japan ..... 417/410.2

*Primary Examiner*—Charles G. Freay

*Attorney, Agent, or Firm*—Armstrong, Westerman, Hattori, McLeland & Naughton

[57] ABSTRACT

In a fluid conveying apparatus in which there is provided, in a flow passage of a fluid, a platelike oscillator which is vibrated with an upstream end thereof, as seen in a flow direction of the fluid, as a fixed end and a downstream end thereof as a free end, the oscillator is divided into minute oscillators of smaller length. The minute oscillators are disposed in longitudinally (back and forth) multiple stages inside the flow passage. A sufficient conveying capacity can thus be obtained even if the flow passage is small in width.

1 Claim, 2 Drawing Sheets

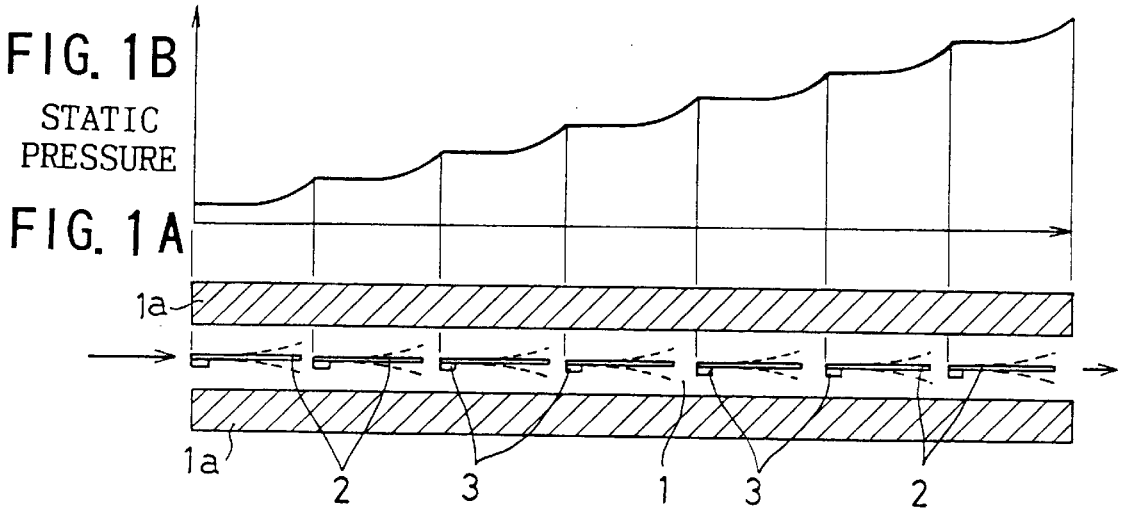
FIG. 1B
STATIC PRESSURE
FIG. 1A
1a
1a
2
3
1
3
2
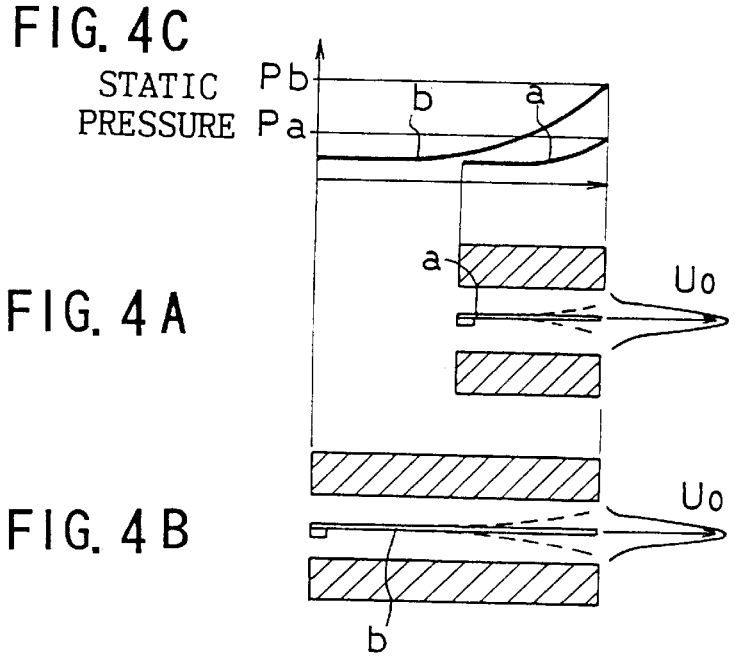
FIG. 4C
STATIC PRESSURE
Pb
Pa
b
a
a
Uo
FIG. 4A
Uo
FIG. 4B
b

FLUID CONVEYING APPARATUS HAVING MULTIPLE PIEZOELECTRIC DRIVEN BLADES

BACKGROUND OF THE INVENTION

1. Field of the Invention

The present invention relates to a fluid conveying apparatus which is used in conveying a fluid through a flow passage of a small width.

2. Description of the Related Art

Conventionally, as this kind of fluid conveying apparatus, one is known in which there is provided, in a flow passage of a fluid, a platelike cantilever oscillator which oscillates or vibrates with an end portion on an upstream side as seen in a fluid flow direction serving as a fixed end and an end portion on a downstream side serving as a free end.

The velocity of that jet on the downstream side of the oscillator which is generated by the vibration of the above-described oscillator is proportional to the velocity of displacement of the oscillator at the free end thereof. If a conveying capacity of a turbo-machine is compared in terms of a Reynolds number with an impeller diameter serving as the characteristic dimension, it is known that the larger the Reynolds number becomes, the larger the conveying capacity becomes. The same applies to the fluid conveying apparatus which uses a cantilever oscillator. Here, in case the velocity of the jet on the downstream side of the oscillator is equal, the Reynolds number increases with the length of the oscillator. Therefore, the inertia force of the fluid per unit volume in the flow passage increases with the length of the oscillator.

There were prepared an arrangement in which a short oscillator "a" is disposed inside an air flow passage as shown in FIG. 4A and an arrangement in which a long oscillator b is disposed inside an air flow passage as shown in FIG. 4B. Each of the oscillators "a" and b was vibrated so that the velocity $U_o$ of a jet becomes equal to each other. The outlet of the air flow passage was closed in this state and the distribution of the static pressure inside the air flow passage was measured. The result of the measurement of the short oscillator "a" was as shown by line "a" in FIG. 4C, and the result of the measurement of the long oscillator b was as shown by line "b" in FIG. 4C. As compared with the static pressure Pa at the outlet in case the short oscillator "a" was disposed, the static pressure Pb at the outlet in case the long oscillator b was disposed has been found to be higher. The difference in the inertia forces depending on the lengths of the oscillators appears as the static pressures difference (=Pb−Pa) between the two.

As described above, in order to increase the fluid conveying capacity (i.e., the capacity of conveying the fluid), the oscillator should be made as large in length as possible. However, if the length increases, a resonance frequency of the oscillator lowers. Especially, if the flow passage becomes smaller in width, it becomes incapable of securing a sufficient amplitude with a long oscillator. As a result, the velocity of displacement at the free end of the oscillator becomes smaller and the velocity of the jet lowers with a consequent decrease in the static pressure at the outlet. A sufficient conveying capacity will therefore no longer be obtainable.

In view of the above-described points, the present invention has an object of providing an apparatus in which the fluid conveying capacity in a flow passage of narrow width can be improved.

SUMMARY OF THE INVENTION

In order to attain the above and other objects, the present invention is a fluid conveying apparatus comprising a cantilevered platelike oscillator which is disposed in a flow passage of a fluid, the oscillator being vibrated with an upstream end thereof as seen in a flow direction of the fluid as a fixed end and a downstream end thereof as a free end, wherein the oscillator is divided into a plurality of minute oscillators, the minute oscillators being disposed in the flow passage of the fluid in longitudinally multiple stages along the flow direction of the fluid.

In the present invention, dividing the oscillator into a plurality of minute oscillators means to divide an oscillator of several cm long or more which is ordinarily used, into oscillators of 10 mm long or less.

Since this kind of minute oscillators are high in resonant frequency and can secure sufficient amplitudes even if the flow passage of the fluid is small in width, the velocity of displacement at the free end can be made large. In addition, even if the increase in static pressure by respective minute oscillators is small, the static pressure can be increased stepwise by disposing the minute oscillators in multiple stages, whereby the static pressure at the outlet can be made relatively high. In this manner, according to the present invention, the fluid conveying capacity in a fluid flow passage of a small width can be largely improved.

Preferably, each of the minute oscillators is constituted by laminating a metallic foil and a piezoelectric film. A frequency of an alternating current voltage to be charged to the piezoelectric film of the minute oscillator located on a downstream side of the flow of the fluid is smaller than a frequency of an alternating current voltage to be charged to the piezoelectric film of the minute oscillator located on an upstream side of the flow of the fluid.

BRIEF DESCRIPTION OF THE DRAWINGS

The above and other objects and the attendant advantages of the present invention will become readily apparent by reference to the following detailed description when considered in conjunction with the accompanying drawings wherein:

FIG. 1A is a sectional view of a first embodiment of the apparatus according to the present invention, and FIG. 1B is a graph showing the distribution of static pressure thereof;

FIG. 4A is a sectional view of a test apparatus using a short oscillator, FIG. 4B is a sectional view of a test apparatus using a long oscillator, and FIG. 4C is a graph showing the distribution of the static pressures in both the test apparatuses.

DETAILED DESCRIPTION OF PREFERRED EMBODIMENTS

FIG. 1A shows an example of a fluid conveying apparatus according to the present invention. Inside a fluid flow passage 1 which is defined by passage walls 1*a*, minute oscillators 2 with a length of 10 mm or less are disposed in longitudinally multiple stages (i.e., in multiple stages in the back and forth direction) along the flow direction of a fluid.

Figure 2:
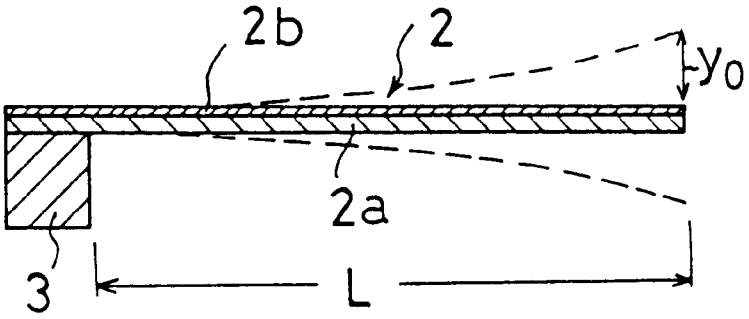
FIG. 2 is an enlarged sectional view of an oscillator.

Each of the oscillators 2 is formed, as shown in FIG. 2, by laminating a piezoelectric film 2*b* on a metallic foil 2*a*. An end portion on an upstream side as seen in the flow direction of the fluid is fixed to a supporting bar 3 which is laterally disposed in the fluid flow passage 1. The piezoelectric film 2*b* is caused to expand and contract in the direction of the fluid flow by charging the piezoelectric film 2*b* with an AC (alternating current) voltage. An end portion on the downstream side as seen in the direction of the fluid flow is thereby caused to vibrate as a free end. Let the length of the oscillator 2 be L, let a half value of the amplitude be $y_o$, and let the width of the fluid flow passage be W. Then, it is preferable to arrange to meet the following conditions.

$$y_o/L \leqq 0.1 \quad (1)$$

$$0.1 \leqq y_o/W \leqq 0.5 \quad (2)$$

Suppose that $y_o/L=0.05$, and by substituting 0.05 L into $y_o$ of formula (2), we have $$2W \leqq L \leqq 10W \quad (3)$$

Therefore, if W=2 mm, L falls within a range of 4 mm through 20 mm. In increasing the number of stages of disposing the oscillators 2, it is preferable to make a setting of L=4 mm.

If the oscillators 2 are disposed in multiple stages as described above, the static pressure inside the fluid flow passage 1 increases stepwise at each oscillator 2 as shown in FIG. 1B. As a result, the static pressure at the outlet of the fluid flow passage 1 will reach a relatively high value. Accordingly, the conveying capacity in a passage of a narrow width such as a toner conveying passage (i.e., a passage for pneumatically conveying a toner) in a copying machine can be improved.

It is when the oscillators 2 are vibrated at their resonance frequency that the conveying capacity becomes maximum. For that purpose, the piezoelectric film 2*b* is charged with an AC voltage corresponding to the resonance frequency of the oscillators 2. Here, the resonance frequency of the oscillators 2 lowers with an increase in the pressure in the vibration field. When the oscillators 2 are disposed in the longitudinally multiple stages, the closer to the rear stage (i.e., downstream side) the oscillator 2 becomes, the lower the resonance frequency becomes as a result of an increase in the static pressure. Therefore, preferably the closer to the rear stage the oscillator 2 becomes, the lower the frequency of the AC voltage to be charged to the piezoelectric film 2*b* is made so that every one of the oscillators 2 is vibrated at its resonance frequency.

Figure 3:
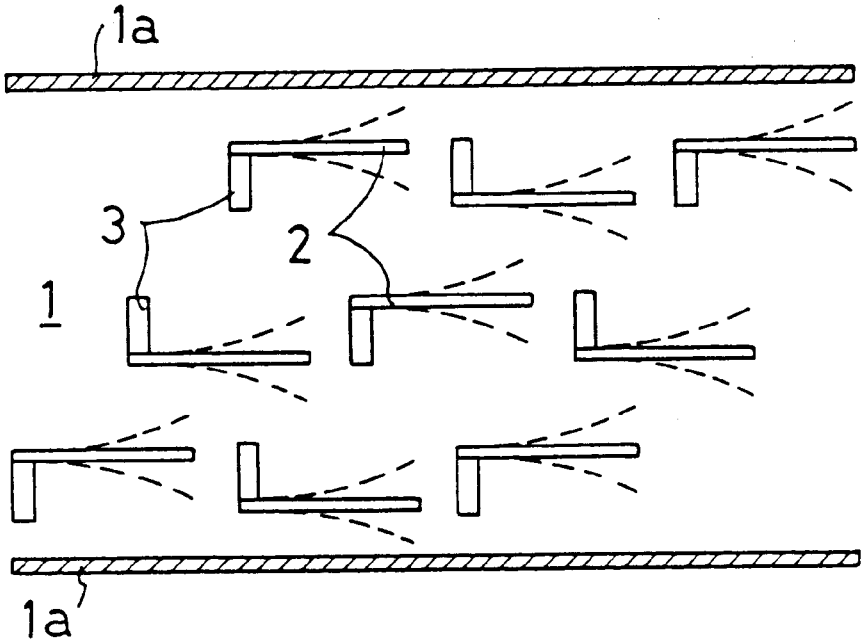
FIG. 3 is a sectional view of a second embodiment of the apparatus according to the present invention.

The oscillators 2 are disposed inside the fluid flow passage 1 in one row in the above-described embodiment. However, if the fluid flow passage 1 is large in width, the oscillators 2 may be disposed in a staggered manner in a plurality of rows as shown in FIG. 3.

It is readily apparent that the above-described fluid conveying apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A fluid conveying apparatus comprising a cantilevered platelike oscillator which is disposed in a flow passage of a fluid, said oscillator being vibrated with an upstream end thereof as seen in a flow direction of the fluid as a fixed end and a downstream end thereof as a free end, wherein said oscillator is divided into a plurality of minute oscillators, said minute oscillators being disposed in said flow passage of the fluid in longitudinally multiple stages along the flow direction of the fluid, each of said minute oscillators being constituted by laminating a metallic foil and a piezoelectric film, and wherein a frequency of an alternating current voltage to be charged to the piezoelectric film of the minute oscillator located on a downstream side of the fluid is smaller than a frequency of an alternating current voltage to be charged to the piezoelectric film of the minute oscillator located on an upstream side of the fluid so that every one of said oscillators can be vibrated at its resonance frequency and the conveyance capacity of said fluid conveying apparatus will be maximum.

* * * * *